US006211834B1

(12) United States Patent
Durham et al.

(10) Patent No.: US 6,211,834 B1
(45) Date of Patent: Apr. 3, 2001

(54) MULTIBAND RING FOCUS ANTENNA EMPLOYING SHAPED-GEOMETRY MAIN REFLECTOR AND DIVERSE-GEOMETRY SHAPED SUBREFLECTOR-FEEDS

(75) Inventors: Timothy E. Durham, Palm Bay; Griffin K. Gothard, Indialantic; Verlin A. Hibner, Melbourne; Michael J. Lynch, Merritt Island, all of FL (US)

(73) Assignee: Harris Corporation, Melbourne, FL (US)

( * ) Notice: Subject to any disclaimer, the term of this patent is extended or adjusted under 35 U.S.C. 154(b) by 0 days.

(21) Appl. No.: 09/163,651

(22) Filed: Sep. 30, 1998

(51) Int. Cl.[7] ..... H01Q 19/19
(52) U.S. Cl. ..... 343/781 P; 343/837
(58) Field of Search ..... 343/781 P, 781 CA, 343/837; H01Q 19/19

(56) References Cited

U.S. PATENT DOCUMENTS

| | | | | |
|---|---|---|---|---|
| 3,710,341 | | 1/1973 | Sciambi, Jr. | 343/779 |
| 3,983,560 | | 9/1976 | MacDougall | 342/781 CA |
| 4,096,483 | | 6/1978 | Bui Hai et al. | 343/781 CA |
| 4,544,928 | | 10/1985 | Afifi et al. | 343/781 P |
| 4,562,441 | | 12/1985 | Beretta et al. | 343/781 P |
| 4,638,322 | | 1/1987 | Lamberty | 343/761 |
| 4,825,222 | | 4/1989 | Butcher | 343/836 |
| 4,827,277 | * | 5/1989 | Becker et al. | 343/781 P |
| 4,963,878 | * | 10/1990 | Kildal | 343/781 P |
| 5,557,292 | | 9/1996 | Nygren et al. | 343/781 P |
| 5,973,652 | * | 10/1999 | Sanford et al. | 343/781 P |

OTHER PUBLICATIONS

"The Theoretical Analysis of Shaped Dual–Reflector Antenna With Ring Focus" by Tao Wang et al, from Conference Proceedings 20th European Microwave Conference 90, vol. 2 pp. 1553–1558.

"Amplitude Aperture–Distribution Control in Displaced–Axis Two–Reflector Antennas" by Alexandre P. Popov and Tom Milligan; IEEE Antennas And Propagation Magazine, vol. 39, No. 6, Dec., 1997. pp. 58–63.

"Two–Reflector Antenna", by Yu A. Brukhimovitch and V.G. Yampolsky, Radio Research Institute, Ministry of Posts and Telecommunications, USSR, pp. 205–207.

"Shaped Dual–Reflector Antenna with Ring Focus", by Zhang et al, Science In China (Series A), Oct. 1991, vol. 34, No. 10, pp. 1243–1255.

* cited by examiner

*Primary Examiner*—Michael C. Wimer
(74) *Attorney, Agent, or Firm*—Allen, Dyer, Doppelt, Milbrath & Gilchrist, P.A.

(57) ABSTRACT

A multiband, shaped ring focus antenna architecture employs only a single or common main reflector, that is shaped such that it can be shared by each of a pair of interchangeable, diversely shaped close proximity-coupled, subreflector-feed pairs designed for operation at respectively different spectral bands. The operational band of the antenna is changed by swapping out the subreflector-feed pairs. Placement of the shaped subreflector in close proximity to the feed horn reduces the diameter of the main shaped reflector relative to a conventional ring focus structure, so as to facilitate installation within a constrained space facility, such as a shipboard-mounted satellite communication system.

35 Claims, 3 Drawing Sheets

MULTIBAND RING FOCUS ANTENNA EMPLOYING SHAPED-GEOMETRY MAIN REFLECTOR AND DIVERSE-GEOMETRY SHAPED SUBREFLECTOR-FEEDS

FIELD OF THE INVENTION

The present invention relates in general to communication systems, and is particularly directed to a new and improved multiband ring focus antenna architecture comprised of a common or shared pseudo parabolically shaped main reflector, and a plurality of diversely configured subreflector-feed pairs, that are interchangeable with each other to provide a reduced sidelobe envelope at a plurality of separate operational frequency bands.

BACKGROUND OF THE INVENTION

Satellite communication systems have customarily employed multi-reflector antenna architectures, often of center-fed Cassegrain configuration, in order to optimize the collection of electromagnetic energy within a prescribed frequency band transmitted over relatively long distances (e.g., earth station-satellite-earth station). Where the number and size of antenna components is not necessarily a major concern, such as a fixed, land-based facility that has ample room for the placement of one or more relatively large structures, it is common practice to employ a relatively large main reflector, and an associated subreflector that is on the order of several tens of wavelengths in diameter. Because of the substantial blockage associated with such a subreflector, the diameter of the main reflector may be in excess of five meters in diameter at C and/or X band. While such a large dimensioned subreflector—main reflector structure is capable of successfully performing its intended functionality for a given operational frequency band, if the earth station is to provide communication capability at separate bands, additional subreflector—main reflector pairs configured for operation at those bands must be installed.

In contrast, many communication systems, such as shipboard-mounted facilities, have only a limited amount of space for the installation of antenna components. In such spatially constrained environments, where antenna size is limited and its directivity pattern must typically comply with a very strict specification, it is not practical to install even one, much less multiple spatially large reflector structures. One proposal to deal with this space constraint problem is to employ a ring focus antenna, having a parabolic main reflector and a 'shaped' (i.e., ellipsoid) subreflector.

Advantageously, the conical properties of the ellipsoid-shaped subreflector provide a dual focus characteristic, with one of its foci displaced toward the vicinity of the aperture of the main reflector where a feed horn is installed. The other focus is symmetric about the antenna axis in the form of a ring, which enables the antenna to obtain a substantially uniform amplitude distribution in the aperture plane. As a consequence of this geometry characteristic, the antenna can is more compact than a conventional center-fed structure.

For non-limiting examples of documentation detailing the configuration and operation of a conventional ring focus antenna, attention may be directed to the following publications: "Amplitude Aperture-Distribution Control in Displaced-Axis Two-Reflector Antennas," by A. Popov et al, Antenna Designer's Notebook, IEEE Antennas and Propagation Magazine, Vol. 39, No. 6, Dec. 1997, pp. 58–63; "The Theoretical Analysis of Shaped Dual-Reflector Antenna with Ring Focus," by T. Wang et al, Conference Proceedings, 20th European Microwave Conference 90, pp 1553–1558; "Shaped Dual-Reflector Antenna with Ring Focus," by R. Zhang et al, Science in China (Series A) Vol. 34, No. 10, Oct. 1991, pp 1243–1255; "Two-Reflector Antenna," by Y. Erukhimovich et al, Radio Research Institute, Ministry of Posts and Telecommunications, USSR, pp. 205–207; and the Canadian Patent to Schwarz, No. 1,191,944, entitled "Improved Shifted Focus Cassegrain Antenna With Low Gain Feed," and assigned to the assignee of the present application.

Now although a ring focus antenna, such as those described in the above literature, is intended to provide reduced subreflector blockage and thereby the overall size of the antenna structure to be smaller than a conventional Cassegrain architecture, its ellipsoid-shaped subreflector is still on the order of several tens of wavelengths in diameter, and is spaced apart from the antenna feed (horn) by similar electrical distance.

To minimize subreflector blockage, the size of the main reflector is still substantial; at C or X band, the main reflector may have a diameter on the order of three meters, depending upon gain and sidelobe requirements. This means that in order to provide communication capability at multiple spectrally separated bands, such as at each of C band and X band, the overall size of two ring focus antenna structures may extend to a diameter on the order of 16–20 feet. This not only places a strain on the space limitations of a facility such as a shipboard-mounted satellite communication system, but does not solve the hardware complexity and cost problems of having to install a separate ring focus pair for each operational band.

SUMMARY OF THE INVENTION

In accordance with the present invention, these problems are effectively obviated by a new and improved, reduced size, multiband, shaped ring focus antenna architecture that employs a single pseudo parabolically shaped main reflector, and a plurality of diversely configured subreflector-feed pairs, that are designed for operation at respectively different spectral bands. The geometric optical properties of the subreflector-feed pairs are such that they may be used with the same shaped main reflector. This allows the operational band of the antenna structure to be readily changed by simply swapping out the subreflector-feed pairs.

As will be described, the term 'shaped' as used to described the present invention is meant a subreflector and main reflector geometry that is defined in accordance with a prescribed set of (reduced sidelobe envelope) directivity pattern relationships and boundary conditions for a prescribed set of equations, rather than a shape that is definable by an equation for a regular conic, such as a parabola or an ellipse. As will be described, given prescribed feed inputs to and boundary conditions for the antenna, the shape of each of a subreflector and a main reflector are generated by executing a computer program that solves a prescribed set of equations for the predefined constraints. In a preferred embodiment, the equations are those which: 1—achieve conservation of energy across the antenna aperture, 2—provide equal phase across the antenna aperture, and 3—obey Snell's law.

While the boundary conditions may be selected to define a regular conical shape, such is not the intent of the shaping of the invention. The ultimate shape of each subreflector and the main reflector are whatever the parameters of the operational specification of the antenna dictate, when applied to the directivity pattern relationships and boundary conditions. As it turns out, because the main reflector produced by the shaping mechanism of the invention has a non-regular conical surface of revolution that is generally (but not necessarily precisely) parabolic, and its associated subreflector has a non-regular conical surface of revolution that is generally (but not necessarily precisely) elliptical, the shape of the main reflector may be termed 'pseudo' parabolic and the shape of the subreflector may be termed 'pseudo' elliptical.

Once the shapes of a subreflector and main reflector pair have been generated, the performance of the antenna is subjected to computer analysis, to determine whether the generated antenna shapes will produce a desired directivity characteristic. If the design performance criteria are not initially satisfied, one or more of the parameter constraints are adjusted, and performance of the antenna is analyzed for the new set of shapes. This process is iteratively repeated, until the shaped pair meets the antenna's intended operational performance specification.

This iterative shaping and performance analysis sequence is also conducted for another spectrally separate band, to obtain a set of subreflector and main reflector shapes at the second operational band. It turns out that the shape of the antenna main reflector produced for each of X and C bands can be made substantially the same, and performance analysis has revealed that the shaped main reflector produced for C band can also be used for X band, although their subreflector-feed pairs are different. As a result, all that is necessary to change operational bands is to interchange the subreflector-feed pairs for the same or common main reflector. This iterative design process can be extended to include any number of distinct frequency bands.

In addition to employing such non-regular conical surfaces of revolution, the shaped ring focus antenna architecture of the invention places the feed (horn) relatively close to the shaped subreflector, e.g., within two wavelengths of the vertex of the subreflector, as contrasted with the multiple tens of wavelengths spacing of a conventional regular conic ring focus antenna, in which the ellipsoid subreflector has a similarly dimensioned diameter. This placement of the shaped subreflector in close proximity to the feed horn provides a further decrease in aperture blockage, and enables the diameter of the main shaped reflector to be substantially reduced relative to that of a conventional ring focus configuration. As a consequence, not only does the shaped ring focus antenna of the invention provide for communication capability at multiple bands, but its reduced size and simplified hardware facilitates installation within the constrained space limitations of a facility such as a shipboard-mounted satellite communication system.

Each shaped subreflector also includes a single generally notch/wedge-shaped, edge current-limiting filter at its peripheral edge. In addition, respective antenna feed filter components are installed at the open ends of the antenna feed horns. For the C band configuration, the feed filter is configured as a conventional external choke contiguous with the outer edge of the forward open end of the feed aperture. For the X band configuration, the feed filter is configured as a set of internal circumferential corrugations that extend a prescribed distance along the interior wall of the feed from the outer edge of the forward open end of the horn (such as a standard corrugated horn with a parabolic flare).

DETAILED DESCRIPTION

As described briefly above, the 'shaped' ring focus antenna architecture of the present invention employs a single shaped main reflector, that is configured so that it can be used interchangeably with each of respectively differently configured subreflectors and associated feeds, to realize a composite optical geometry characteristic that satisfies the same set of antenna performance criteria (e.g., a directivity pattern having a reduced or substantially suppressed sidelobe envelope) at respectively different operational frequency bands.

For this purpose, given prescribed feed inputs to and boundary conditions for the antenna, the shape of each of a subreflector and a main reflector are generated by executing a computer program that solves a prescribed set of equations for the predefined constraints. In accordance with a preferred embodiment of the invention, the equations employed are those which: 1—achieve conservation of energy across the antenna aperture, 2—provide equal phase across the antenna aperture, and 3—obey Snell's law.

In particular, the equations are as follows:

$$\int_{\theta 1\min}^{\theta 1\max} P_1(\theta_1)\sin\theta_1\, d\theta_1 = \int_{x_{2\min}}^{x_{2\max}} P_2(x_2)x_2\, dx_2 \tag{1}$$

$$R1 + R2 + R3 = \text{constant} \tag{2}$$

$$\frac{dy_1}{dx_1} = \tan\left(\frac{\theta_1 - \theta_2}{2}\right);\ \frac{dy_2}{dx_2} = \tan\left(\frac{\theta_2}{2}\right) \tag{3}$$

Figure 1:
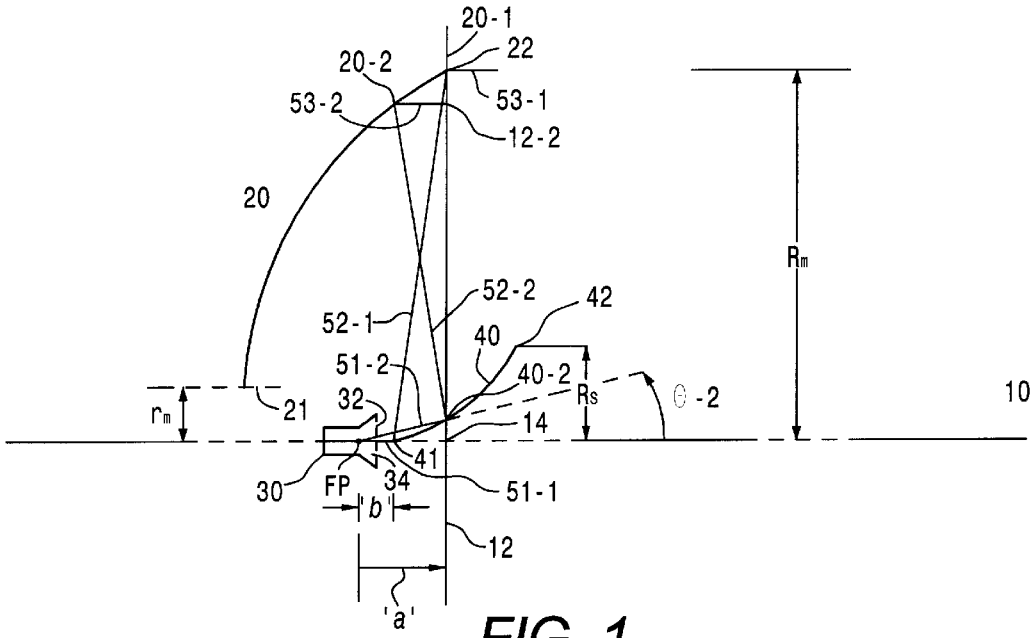
FIG. 1 is an antenna geometry optics diagram for illustrating a 'shaped' multiband ring focus antenna architecture in accordance with the present invention.
Figure 6:
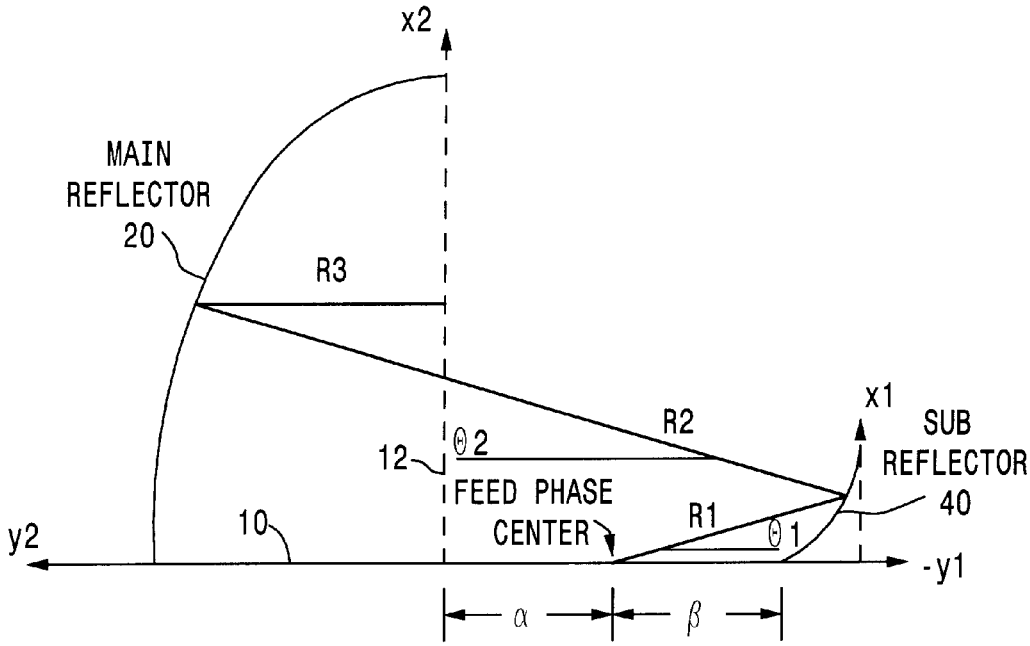
FIG. 6 is a more detailed enlarged geometry optics version of FIG. 1.

The parameters used with these equations and the associated antenna geometry defined thereby is diagrammatically illustrated in FIG. 6, which is a more detailed enlarged geometry optics version of FIG. 1, to be described.

For a given set of generated subreflector and main reflector shapes, the performance of the antenna is then analyzed by way of computer simulation, to determine whether the generated antenna shapes will produce a desired directivity characteristic, such as one that is compliant with Intelsat sidelobe envelope requirements at a prescribed operational band (e.g., C band having a receive bandwidth of 3.7–4.2 GHz and a transmit bandwidth of 5.9–6.4 GHz). If the design performance criteria are not initially satisfied, one or more of the equations' parameter constraints are iteratively adjusted, and the performance of the antenna is analyzed for the new set of shapes. This process is iteratively repeated, as necessary until the shaped antenna subreflector and main reflector pair meets the antenna's intended operational performance specification.

This iterative shaping and performance analysis sequence is also conducted for another (spectrally separate) band, such as X band having a receive bandwidth of 7.25–7.75 and a transmit bandwidth of 7.9–8.4 GHz, to realize a set of subreflector and main reflector shapes at the second operational band. It turns out that the shape of the antenna main reflector produced for each of these spectrally diverse bands can be made substantially the same; as a result of performance analysis it has been determined that the shaped main reflector produced for C band can also be used for X band, although differently configured subreflectors are used for each band.

This means that all that is necessary to change operational bands (from C band to X band, or from X band to C band) is to swap out or interchange the subreflectors and their associated feeds. Moreover, although each set of subreflector and main reflector shapes may be derived separately, as described above, it is also possible to derive a first set of shapes for a first band, and then use the parameters for the (first band) shaped main reflector (which is also to be used for the second band) to derive the shape of the subreflector for the second band.

The manner in which a 'shaped' ring focus antenna architecture in accordance with the present invention may be obtained from the above set of equations may be understood by reference to the antenna geometry optics diagram of FIG. 1 (and its associated detailed geometry optics diagram of FIG. 6), which shows an antenna boresight axis 10 and an antenna aperture plane 12 that intersects and is orthogonal to the boresight axis 10. The antenna includes a shaped main reflector 20, that is symmetric about the boresight axis 10. Main reflector 20 extends from some interior main reflector feed entry or opening 21 of radius rm from the boresight axis 10 to an outer or perimeter edge 22 in the aperture plane 12.

An antenna feed 30, such as a feed horn or section of open ended waveguide, having a forward open end 32 of a feed aperture 34, is located in and is symmetric about the boresight axis 10. The forward open end 34 of the feed, which may contain or be adjacent to a subreflector focal point FP is spaced from the intersection 14 of the axis 10 with the aperture plane 12 by a distance 'a'. Also located in and symmetric about the boresight axis 12 is the vertex or tip 41 of a shaped subreflector 40, that is symmetric about the boresight axis 10 and is spaced apart from the focal point by a distance 'b'. The shaped subreflector 40 has a radius Rs, that extends orthogonally from the boresight axis 10 to an outer or perimeter edge 42, where an edge current-limiting notch/wedge-shaped filter to be described is located.

Given a phase center of electromagnetic energy emitted from (or received by) the subreflector focal point FP, a first (boresight—perimeter boundary) multi-segment ray 50-1 may be defined as a spatial sequence or arrangement of a set of linear ray segments as follows: a first linear ray segment 51-1 (extending from the focal point FP along the boresight axis 10 to the subreflector vertex 41 and having a first phase angle Θ-1 =0 relative to boresight axis 10); a second linear ray segment 52-1 (extending from the subreflector vertex 41 to the main reflector perimeter edge 22); and a third linear ray segment 53-1 (extending from the perimeter edge 22 to a point 12-1 in the aperture plane 12). As the perimeter edge 22 is coincident with point 12-1 in the aperture plane 12, the length of the ray segment 53-1 is zero.

Figure 2:
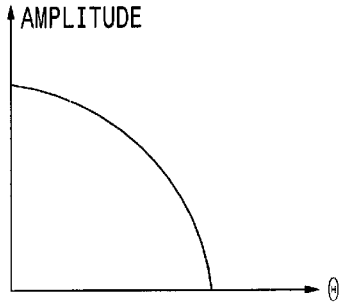
FIG. 2 is a non-limiting example of a magnitude vs. angle Θ characteristic of an antenna feed.

For a prescribed antenna feed pattern, such as one having the magnitude vs. angle Θ characteristic shown in FIG. 2, as a non-limiting example, at successive increments of phase angle Θ-2, Θ-3, . . . , Θ-N relative to the boresight axis 10 from the focal point FP (one of which is shown at Θ-2), additional multi-segment rays 50-2, 50-3, . . . , 50-N (one of which is shown at 50-2), having the same length as ray 50-1 to provide equal phase across the aperture plane 12, and satisfying Snell's law with respect to points 20-i on the main reflector 20 and points 40-i on the subreflector 40 to ensure equal angles of incidence and reflection relative to the subreflector and main reflector surfaces, may be defined. These additional rays are comprised of successive linear ray segments 51-2, 51-3, . . . , 51-N (one of which is shown at 51-2), extending from the focal point FP to successive subreflector points 40-2, 40-3, . . . , 40-N (one of which is shown at 40-2), linear ray segments 52-2, 52-3, . . . , 52-N (one of which is shown at 52-2), extending from subreflector points 40-2, 40-3, 40-N to successive points 20-2, 20-3, 20-N (one of which is shown at 20-2) along the main reflector 20, and linear ray segments 53-2, 53-3, . . . , 53-N (one of which is shown at 53-2) extending from successive points 20-2, 20-3, 20-N along the main reflector 20 to points 12-2, 12-3, 12-N in the aperture plane 12 (one of which is shown at 12-2).

Each of the multi-segment rays 50-i that establish the optical properties of the ring focus antenna of FIG. 1 is not only defined in accordance with equations (2) and (3), as described above, but also with the conservation of energy relationship of equation (1). While equation (1) serves to confine and substantially evenly distribute all of the energy emanating from or received by the feed horn within the reflection geometries of the subreflector and main reflector surfaces, the parameters of equation (1) may be tailored to realize a modified energy distribution characteristic associated with an intended adjustment of the antenna's directivity pattern. For example, equation (1) may be adjusted as necessary to provide a prescribed 'tapering' of the energy at peripheral portions of the reflector surfaces, in order to provide substantial suppression of the sidelobe envelope.

As pointed out above, as equations (1), (2) and (3) are solved and respective associated sets of subreflector and main reflector shapes are generated for iteratively adjusted values of input parameters to the antenna feed and boundary conditions of the antenna (including main reflector outer radius Rm, main reflector interior opening radius rm, subreflector radius Rs, focal point-aperture plane spacing 'a', and focal point to subreflector tip spacing 'b'), the resultant directivity characteristic is analyzed for each of a plurality of spectrally separate frequency bands (e.g., C band and X band, as non-limiting examples), until it tentatively satisfies a prescribed design specification. In the present non-limiting example, the intended directivity characteristic is defined to be compliant with Intelsat sidelobe suppression requirements. As noted previously, performance analysis has revealed that the same main reflector shaped for C band can also be used for X band, although differently configured subreflectors are produced for each band.

In the more detailed geometry optics diagram of FIG. 6, equations (1), (2) and (3), set forth above, are solved given the following boundary conditions:

$\alpha$, $\beta$, $\Theta_{min}$, $\Theta_{max}$, $x_{2min}$, $x_{2max}$, and the form of $P_2(x_2)$. Two additional constraints are: i) to allow $P_2$ to be uniform in the aperture of the main reflector 20, which results in maximum gain with approximately 17dB sidelobes; and ii) forcing $P_2$ to taper to −80dB at the outer edge of the main reflector 20, which results in an extreme loss of gain with very low sidelobes. A practical (real time) trade-off between constraints i) and ii) is employed to develop the desired directivity pattern (within limits imposed by the feed, and the sizes of the main reflector 20 and the subreflector 40).

In addition to being preliminarily shaped in accordance with the geometry optics-based process described above, the subreflector in accordance with the present invention has two additional features that enable the antenna of the present invention to achieve its intended performance criterion (e.g., Intelsat specification-defined directivity pattern). First, it has been found that reducing the focal point-subreflector vertex spacing 'b', so as to bring the terminal end 32 of the feed horn 30 within very close proximity (i.e. within two and preferably less than one and one-half wavelengths) of the vertex 41 of the subreflector 40, effectively creates a very compact or 'close proximity-coupled' feed-subreflector radiating structure, that effectively obviates the problem of phase center migration with frequency of a conventional subreflector—feed spacing, which is typically on the order of several to tens of wavelengths, as referenced previously.

Figure 3:
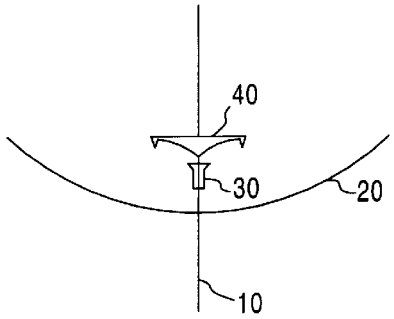
FIG. 3 is a simplified antenna diagram of a multiband shaped antenna of the invention.

Moreover, this compact structure allows the subreflector to main reflector spacing along the boresight axis to be reduced to a value on the order of tens of inches, as shown diagrammatically in the antenna geometry diagram of FIG. 3. It has been found that, at either X band or C band, a main reflector 20 shaped in accordance with the invention may have a radius Rm on the order of only forty-five inches or so. This allows a multi (dual) band capability antenna to be installed within a space that is only half the size of a conventional ring focus architecture, making the antenna of the invention readily installable within a constrained space facility such as a shipboard-mounted satellite communication system.

Figure 4:
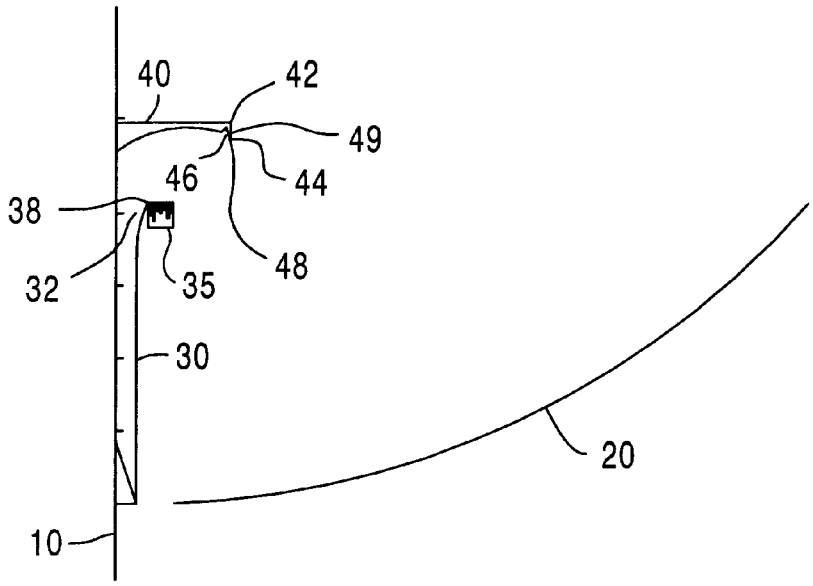
FIG. 4 is a partial boresight sectional diagram of a shaped antenna architecture of the invention for operation at C band.
Figure 5:
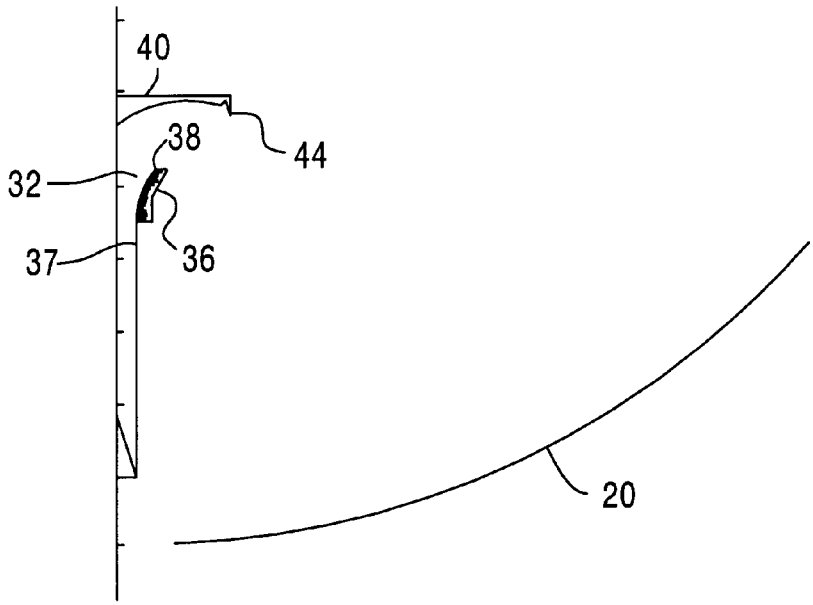
FIG. 5 is a partial boresight sectional diagram of a shaped antenna architecture of the invention for operation at X band.

A second additional feature of the subreflector of the present invention is the placement of a generally notch/wedge-shaped filter at a peripheral edge thereof. More particularly, FIGS. 4 and 5 diagrammatically show half-portions of boresight symmetrical antenna structures, that are obtained in accordance with the shaping process described above for C band and X band operation. As shown therein, in the radial direction outwardly from the boresight axis 10, the outer peripheral edge 42 of the shaped surface 40 of each (C band and X band) subreflector terminates or is bounded by an edge current limiting filter 44 having a single generally deep V-shaped notch 46. Notch 46, in turn, is contiguous with a single wedge 48 at the circumference 49 of the subreflector 40. Wedge 48 projects generally in a direction parallel with the boresight axis toward the main reflector 20. Filter 44 is operative to reduce radial currents at the peripheral edge of the subreflector. The shapes and dimensions of the filter 44 are determined empirically.

Also shown in FIGS. 4 and 5 are respective antenna feed filter components of conventional construction that are installed at the open ends of the antenna feed horns. For the C band configuration of FIG. 4, a filter 35 is configured as a conventional external choke that is contiguous with the outer edge 38 of the forward open end 32 of the feed 30. For the X band configuration of FIG. 5, a filter 36 is configured as a set of internal circumferential corrugations that extend a prescribed distance along the interior wall 37 of the feed from the outer edge 38 of the forward open end 32 of the feed 30.

As will be appreciated from the foregoing description, the spatial and performance constraints of conventional Cassegrain and regular conic ring focus antenna geometries, described above, are effectively obviated by the multiband shaped ring focus antenna architecture of the present invention, which employs only a single or common main reflector, that is shaped such that it can be shared by each of a pair of diversely configured but interchangeable, close proximity-coupled, subreflector-feed pairs designed for operation at respectively different spectral bands. Since the subreflector-feed pairs may be used with the same shaped main reflector, the operational band of the antenna is readily changed by simply swapping out the subreflector-feed pairs. Also, placement of the shaped subreflector in close proximity to the feed horn helps reduce the diameter of the main shaped reflector relative to that of a conventional ring focus configuration. Consequently, not only does the shaped ring focus antenna of the invention provide for communication capability at multiple bands, but its reduced size and simplified hardware facilitates installation within the constrained space limitations of a facility such as a shipboard-mounted satellite communication system. It should also be noted that the invention is not limited to use with any band or groups of bands. X and C bands have been given for purposes of providing a non-limiting example. Other antenna applications, such as those designed for use at Ku band and Ka band, as well as X band and C band, may also benefit from the present invention.

While we have shown and described an embodiment in accordance with the present invention, it is to be understood that the same is not limited thereto but is susceptible to numerous changes and modifications as are known to a person skilled in the art, and we therefore do not wish to be limited to the details shown and described herein, but intend to cover all such changes and modifications as are obvious to one of ordinary skill in the art.

What is claimed:

1. An antenna comprising:

a main reflector having a shaped surface of revolution about a boresight axis of said antenna and being operable at a plurality spectrally offset frequency bands;

a sub-reflector having a shaped non-linear surface of revolution about said boresight axis, said sub-reflector forming a ring-shaped focal point characteristic about said boresight axis; and a feed element installed at a feed element location adjacent to a vertex of said sub-reflector on said boresight axis of said antenna; and wherein at least said shaped sub-reflector has no continuous surface portion thereof shaped as a regular conical surface of revolution.

2. An antenna according to claim 1, wherein said feed element location is adapted to have individually installed thereat each of a plurality of different feed elements respectively configured for operation at different ones of said spectrally offset frequency bands, and defining with an associated sub-reflector, having said shaped non-linear surface of revolution about said boresight axis and forming a ring-shaped focal point characteristic about said boresight, a respectively different one of said spectrally offset frequency bands of operation of said antenna.

3. An antenna according to claim 2, wherein said spectrally different frequency bands comprise selected ones of X band, C band Ku band and Ka band.

4. An antenna according to claim 2, wherein said spectrally different frequency bands comprise C band, X band and Ku band.

5. An antenna according to claim 2, wherein said spectrally different frequency bands comprise C band, X band and Ka band.

6. An antenna according to claim 2, wherein said spectrally different frequency bands comprise X band, Ku band and Ka band.

7. An antenna according to claim 2, wherein said spectrally different frequency bands comprise C band, Ku band and Ka band.

8. An antenna according to claim 2, wherein said spectrally different frequency bands comprise X band and C band.

9. An antenna according to claim 1, wherein said feed element has a feed aperture thereof located less than two wavelengths of the frequency of operation of said antenna from said vertex of said sub-reflector.

10. An antenna according to claim 9, wherein a peripheral edge of said sub-reflector has an edge current limiting filter, having a generally V-shaped notch that is contiguous with a generally V-shaped wedge projecting in a direction generally parallel to said boresight axis toward said main reflector, and being operative to reduce radial currents at said peripheral edge of said sub-reflector.

11. An antenna according to claim 1, wherein said main reflector and said sub-reflector are shaped as respectively different non-regular conical surfaces of revolution.

12. An antenna according to claim 11, wherein said sub-reflector is shaped as a distorted ellipsoid and said main reflector is shaped as a distorted paraboloid.

13. An antenna according to claim 1, wherein a peripheral edge of said sub-reflector has an edge current limiting filter, having a generally V-shaped notch that is contiguous with a generally V-shaped wedge projecting in a direction generally parallel to said boresight axis toward said main reflector, and being operative to reduce radial currents at said peripheral edge of said sub-reflector.

14. An antenna according to claim 2, wherein said plurality of different feed elements include a first feed horn of revolution about said boresight axis operative at a first frequency band and having internal corrugations adjacent to a peripheral aperture edge thereof, and a second feed horn of revolution about said boresight axis operative at a second frequency band, that does not spectrally overlap said first frequency band, and having an external choke structure at peripheral aperture edge thereof.

15. An antenna according to claim 1, wherein said sub-reflector comprises a selected one of a plurality of different sub-reflectors respectively configured for operation at different frequency bands, and wherein said feed element comprises a selected one of a plurality of different feed elements respectively configured for operation at said different frequency bands, whereby the band of operation of said antenna is that of said selected sub-reflector and said selected feed element.

16. An antenna according to claim 15, wherein said different frequency bands comprise selected ones of X band, C band, Ka band and Ku band.

17. An antenna according to claim 1, wherein each of said shaped main reflector and said shaped sub-reflector has no continuous surface portion thereof shaped as a regular conical surface of revolution.

18. An antenna according to claim 17, wherein said shaped main reflector is shaped as a non-regular paraboloid, and said shaped sub-reflect or shaped as a non-regular ellipsoid.

19. A ring focus antenna having a main reflector of revolution shaped as a non-regular paraboloid about a boresight axis of said antenna, a sub-reflector of revolution shaped as a non-regular ellipsoid having a ring-shaped focal point characteristic about said boresight axis, and a feed element located less than two wavelengths of the frequency of operation of said antenna from said vertex of said sub-reflector.

20. An antenna according to claim 19, wherein a peripheral edge of said subreflector has an edge current limiting filter, having a generally V-shaped notch that is contiguous with a generally V-shaped wedge projecting in a direction generally parallel to said boresight axis toward said main reflector, and being operative to reduce radial currents at said peripheral edge of said sub-reflector.

21. An antenna according to claim 20, wherein said antenna is operative at a plurality of spectrally different frequency bands.

22. An antenna according to claim 21, wherein said spectrally different frequency bands comprise selected ones of X band, C band Ku band and Ka band.

23. An antenna according to claim 19, wherein each of a plurality of different feed elements, respectively configured for operation at spectrally different frequency bands, is individually installable as said feed element so as to define with an associated sub-reflector, that is shaped as a non-regular ellipsoid about said boresight axis and forming a ring-shared focal point characteristic about said boresight axis, a respectively different one of said spectrally offset frequency bands of operation of said antenna.

24. A method of configuring an antenna for operation at a selected one of a plurality of different frequency bands comprising the steps of:

(a) providing a main reflector having a shaped, non-regular conical surface of revolution about a boresight axis of said antenna;

(b) locating a sub-reflector, having a shaped, non-regular conical surface of revolution about said boresight axis, in spaced apart relationship with said main reflector along said boresight axis, said shaped, non-regular conical surface of said sub-reflector having a ring-shaped focus characteristic about said boresight axis, said sub-reflector being selected from a plurality of respectively different sub-reflectors having shaped, non-regular conical surfaces of revolution about said boresight axis and configured for operation at spectrally different frequency bands; and (c) locating a feed element adjacent to a vertex of said subreflector on said boresight axis, said feed element being selected from a plurality of different feed elements respectively configured for operation at said spectrally different frequency bands, said selected feed element being configured for operation at the band of operation of said selected sub-reflector.

25. A method according to claim 24, wherein step (c) comprises locating said feed element such that its feed aperture is within two wavelengths of the frequency of operation of said antenna of said vertex of said sub-reflector.

26. A method according to claim 24, wherein said sub-reflector has a wedge-shaped filter at a peripheral edge thereof, which is operative to reduce current at said peripheral edge of said subreflector.

27. A method according to claim 24, wherein said spectrally different frequency bands comprise selected ones of X band, C band, Ku band and Ka band.

28. A method according to claim 24, further comprising the step of:

(d) configuring said antenna for operation at a frequency band different from said selected band by (d1) retaining said main reflector of step (a), (d2) replacing said selected sub-reflector of step (b) with another of said plurality of respectively different sub-reflectors, and (d3) replacing said selected feed element of step (c) with another of said plurality of a respectively different sub-reflector; and wherein each of said another subreflector of step (d2) and said another feed element of step (d3) is configured for operation at said different frequency band.

29. A method according to claim 28, wherein steps (a) and (b) comprise respectively shaping said main reflector and said plurality of sub-reflectors, so as to constrain sidelobes of said antenna's directivity pattern to within a prescribed sidelobe specification at each of said respectively different bands of said selected sub-reflector of step (b) and said another sub-reflector of step (d2).

30. A method according to claim 28, wherein said selected sub-reflector of step (b) and said feed element of step (c) are configured for operation at one of X band, C band, Ku band and Ka band, and said another sub-reflector of step (d2) and said feed element of step (d3) are configured for operation at another of X band, C band Ku band and Ka band.

31. An antenna adapted to be operational at a selected one of a plurality of different frequency bands comprising:

a main reflector having a shaped, non-regular conical surface of revolution about a boresight axis of said antenna;

a sub-reflector, having a shaped, non-regular conical surface of revolution about said boresight axis, located in spaced apart relationship with said main reflector along said boresight axis, said shaped, non-regular conical surface of said sub-reflector having a ring-shaped focus characteristic about said boresight axis, said sub-reflector being selected from a plurality of respectively different sub-reflectors having shaped, non-regular conical surfaces of revolution about said boresight axis and configured for operation at spectrally different frequency bands; and a feed element located adjacent to a vertex of said sub-reflector on said boresight axis, said feed element being selected from a plurality of different feed elements respectively configured for operation at said spectrally different frequency bands, said selected feed element being configured for operation at the band of operation of said selected sub-reflector.

32. An antenna according to claim 31, wherein said feed element is located such that its feed aperture is within two wavelengths of the frequency of operation of said antenna of said vertex of said sub-reflector.

33. An antenna according to claim 31, wherein said sub-reflector has a wedge-shaped filter at a peripheral edge thereof, which is operative to reduce current at said peripheral edge of said sub-reflector.

34. An antenna according to claim 31, wherein said spectrally different frequency bands comprise selected ones of X band, C band, Ku band and Ka band.

35. An antenna according to claim 31, wherein said main reflector and said sub-reflector are shaped to constrain sidelobes of said antenna's directivity pattern to within a prescribed sidelobe specification at each of said respectively different bands of said plurality of respectively different sub-reflectors.

* * * * *

UNITED STATES PATENT AND TRADEMARK OFFICE

CERTIFICATE OF CORRECTION

PATENT NO. : 6,211,834 B1
DATED : April 3, 2001
INVENTOR(S) : Timothy E. Durham, Griffin K. Gothard, Verlin A. Hibner, Michael J. Lynch It is certified that error appears in the above-identified patent and that said Letters Patent is hereby corrected as shown below:

Column 9,
Line 55, delete "sub-reflect or" insert -- sub-reflector --

Column 10,
Line 17, delete "ring-shared" insert -- ring-shaped --

Signed and Sealed this

Twenty-ninth Day of January, 2002

*Attest:*

*Attesting Officer*

JAMES E. ROGAN
*Director of the United States Patent and Trademark Office*